United States Patent [19]

Mamizuka et al.

[11] Patent Number: 4,746,950

[45] Date of Patent: May 24, 1988

[54] COLOR COPIER

[75] Inventors: Mitsuru Mamizuka, Tokyo; Hideya Furuta, Yokohama; Yutaka Koizumi, Kawasaki; Yoshihiro Sakai, Tokyo, all of Japan

[73] Assignee: Ricoh Company, Ltd., Tokyo, Japan

[21] Appl. No.: 817,041

[22] Filed: Jan. 8, 1986

[30] Foreign Application Priority Data

| | | | |
|---|---|---|---|
| Jan. 9, 1985 | [JP] | Japan | 60-1808 |
| Jan. 9, 1985 | [JP] | Japan | 60-1809 |
| Feb. 7, 1985 | [JP] | Japan | 60-16106[U] |
| Feb. 7, 1985 | [JP] | Japan | 60-16107[U] |
| Feb. 7, 1985 | [JP] | Japan | 60-16108[U] |
| Feb. 9, 1985 | [JP] | Japan | 60-17255[U] |
| Feb. 9, 1985 | [JP] | Japan | 60-17256[U] |
| Feb. 9, 1985 | [JP] | Japan | 60-17257[U] |

[51] Int. Cl.[4] ..... G03G 15/01

[52] U.S. Cl. ..... 355/4

[58] Field of Search ..... 355/3 R, 3 SH, 3 TR, 355/4, 14 TR

[56] References Cited

U.S. PATENT DOCUMENTS

| | | | |
|---|---|---|---|
| 3,647,293 | 3/1972 | Queener | 355/15 |
| 3,764,207 | 10/1973 | Obuchi | 355/3 TR |
| 3,914,042 | 10/1975 | Watson | 355/3 TR |
| 3,981,576 | 9/1976 | Inoue | 355/4 |
| 4,162,843 | 7/1979 | Inoue et al. | 355/4 |
| 4,185,910 | 1/1980 | Nomura et al. | 355/15 |
| 4,239,370 | 12/1980 | Kurita | 355/4 |
| 4,429,986 | 2/1984 | Abe et al. | 355/8 |
| 4,431,301 | 2/1984 | Hashimoto et al. | 355/3 TR X |
| 4,518,246 | 5/1985 | Spitzner et al. | 355/4 |

FOREIGN PATENT DOCUMENTS

| | | | |
|---|---|---|---|
| 57-85066 | 5/1982 | Japan | 355/4 |
| 59-111653 | 6/1984 | Japan | 355/4 |

*Primary Examiner*—Fred L. Braun

*Attorney, Agent, or Firm*—Cooper & Dunham

[57] ABSTRACT

A color copier scans an original carrying a multi-color image in one direction to form toner images of different color components thereof on respective photosensitive drums while moving a transfer sheet in the opposite direction to transfer in registration thereon the several toner images and thereby form a composite color image of the original without reversing the rotational direction of the drums. After the latent image on a given drum is developed with a toner of a respective color, the drum is quenched to remove residual charge by irradiating it with light of a color which is not significantly absorbed by the toner on the drum. The quenching light color differs as between different drums, and for a given drum the quenching light color differs from the color of the light used to form the latent image on that drum.

11 Claims, 2 Drawing Sheets

COLOR COPIER

BACKGROUND OF THE INVENTION

1. Field of the Invention

This invention generally relates to an electrophotographic copying apparatus, and, in particular, to a color copier which employs a plurality of photosensitive drums for transferring color-separated toner images to a transfer medium to obtain a reproduced color image.

2. Description of the Prior Art

A color copier using a plurality of photosensitive drums for different color-separated images is well known in the art. In such a prior art color copier, after forming toner images of different colors on respective photosensitive drums, the drums are driven to rotate in the reversed direction and, at the same time, a sheet of transfer paper is transported by means of a transfer belt in the same direction as the forward moving direction of an original holder, whereby the toner images different in color are transferred to the sheet of transfer paper one after another in sequence thereby producing a color copy of an original image. However, in the prior art color copier, since the direction of rotation of the photosensitive drums is reversed, fluctuations in load are produced in a driving system, which, in turn, would cause mismatching or positional discrepancy between color-separated images. Since a transfer belt is provided for each of the plurality of photosensitive drums and the transfer belts are individually driven to run, fluctuations in load are also produced during transfer of image, which also would cause the color-separated images to be misaligned when superposed one on top of another on the same sheet of transfer paper.

SUMMARY OF THE INVENTION

In accordance with the present invention, there is provided a color copier which comprises holding means driven to move along a first predetermined path in a reciprocating manner for holding thereon an original to be copied, scanning means for scanning said original while said holding means moves in a forward direction along said first predetermined path, a plurality of imaging means for forming thereon toner images of different color components of said original, and transporting means for transporting a transfer medium along a second predetermined path, which is generally in parallel with said first predetermined path, in a direction opposite to said forward direction thereby transferring said toner images one after another in sequence from said plurality of imaging means to said transfer medium to obtain a reproduced color copy of said original. In the preferred embodiment, the transporting means is so provided to shift in position between first and second positions such that the transporting means is normally located at the first position, where the transporting means is separated away from at least one of the imaging means, and the transporting means is shifted to the second position, where the transporting means is in contact with at least one of the imaging means when the toner image is to be transferred to the transfer medium from the imaging means. Preferably, each of the imaging means includes a photosensitive drum and the transporting means includes a transfer belt which extends long enough to transport the transfer medium along the second predetermined path to have the toner images transferred to the transfer medium from each of the photosensitive drums.

In one form of the present invention, there is provided an electrophotographic color copying apparatus which comprises an original holder for holding thereon an original to be copied and driven to move along a first predetermined path in a reciprocating manner, three imaging stations disposed side-by-side in series along the first predetermined path, each station forming a toner image of the corresponding color component image of the original, and transporting means for transporting a transfer medium along a second predetermined path past each of the three imaging stations thereby transferring the toner image to the transfer medium at each of the three imaging stations. Each of the imaging stations includes a photosensitive drum driven to rotate in a predetermined direction, a primary charging device for charging the drum uniformly to a predetermined polarity, an illuminating device for illuminating the original, an exposing system for exposing the original to the drum to form an electrostatic latent image of a selected color component on the drum, a developing device for developing the latent image with toner of said selected color to form a toner image, a transferring device for transferring the toner image to the transfer medium transported by the transporting means. Each station may also includes a pretransfer charging device disposed between the developing device and the transferring device and a quenching lamp disposed between the transferring device and the primary charger.

In this embodiment, since three imaging stations are provided, the original is decomposed into three color component images, for example, of three primary colors, and these color component images are developed with respective toners of selected colors, such as cyan, magenta and yellow. Thus, there are produced three toner images for the three different color components of the original and each of these cyan, magenta, and yellow toner images is then transferred to the transfer medium one after another in sequence while the transfer medium moves past the corresponding imaging station. Preferably, the transporting means includes an endless transporting belt which extends long enough to transport the transfer medium past each of the three imaging stations one after another and which is normally in rolling contact with one of the three photosensitive drums but separated away from the other two drums, so that the transporting belt is brought into rolling contact with each of the other two drums when the toner image is to be transferred therefrom to the transfer medium being transported by the belt.

It is therefore a primary object of the present invention to obviate the disadvantages of the prior art as described above and to provide an improved color copier.

Another object of the present invention is to provide an improved color copier using a plurality of imaging means for different color-component images of an original image.

A further object of the present invention is to provide an improved color copier simple in structure and compact in size.

A still further object of the present invention is to provide an improved color copier excellent in alignment between different color component images when transferred to the same transfer medium.

Other objects, advantages and novel features of the present invention will become apparent from the following detailed description of the invention when considered in conjunction with the accompanying drawings.

DESCRIPTION OF THE PREFERRED EMBODIMENTS

Figure 1:
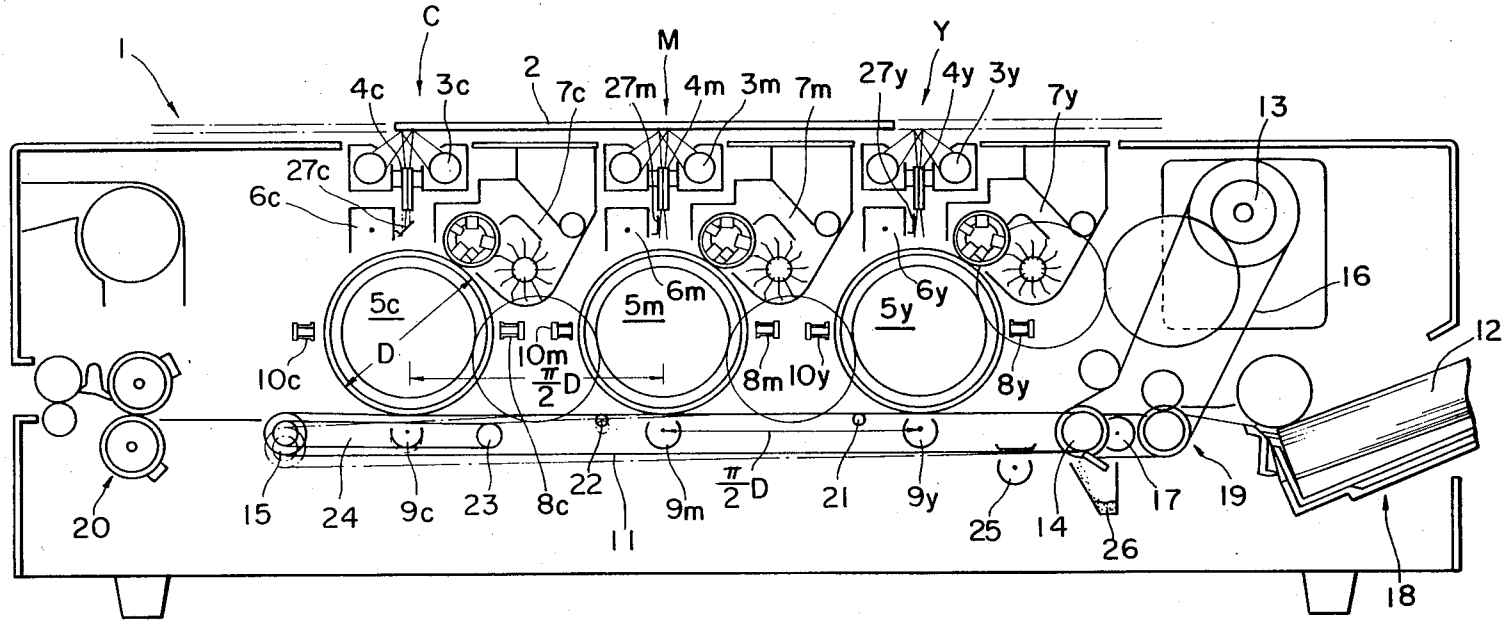
FIG. 1 is a schematic illustration showing the overall structure of a color copier constructed in accordance with one embodiment of the present invention.

Referring now to FIG. 1, there is shown a color copier 1 of the electrophotographic type constructed in accordance with one embodiment of the present invention. As shown, the color copier 1 includes an original holder 2 which is disposed on top of a housing such that it can be driven to move horizontally along the top surface of the housing in a reciprocating manner. It is to be noted that the leftmost position of the original holder 2 along its travelling path indicated by the one-dotted line in FIG. 1 is a home position, and, thus, when the original holder 2 moves from left to right in FIG. 1, it will be said that the original holder 2 moves in a forward direction. The color copier 1 includes three imaging stations C, M, and Y disposed inside of the housing and below the travelling path of the original holder 2 in a side-by-side arrangement. It is to be noted that these three imaging stations are basically identical in structure excepting that they deal with different color component images of an original placed on the original holder 2. A first imaging station C processes a first selected color component image and thus it uses toner of first selected color, or cyan toner in the present embodiment. Similarly, second and third imaging stations M and Y process second and third selected color component images, respectively, and, thus, they use toners of second and third selected colors, or magenta and yellow toners in the present embodiment, respectively.

The first imaging station C includes a photosensitive drum 5*c* having a diameter D and driven to rotate clockwise, a primary corona charging device 6*c* for charging the peripheral surface of the drum 5*c* to a predetermined polarity uniformly, an illuminating device 3*c* for illuminating the original (red color light), an image exposing system 4*c*, a developing device 7*c* with cyan toner, a pretransfer corona device 8*c*, an image transfer corona device 9*c*, and a quenching lamp 10. With this structure, as the original holder 2 moves in the forward direction, the original on the holder 2 is exposed in red light to peripheral surface of the drum 5*c* by means of the lamp 3*c* and the exposing system 4*c*, and, thus, the peripheral surface of the drum 5*c*, which has been uniformly charged to a predetermined polarity by the primary charging device 6*c*, receives the red color component image of the original thereby forming its latent image thereon. Then, the latent image is developed by the developing device 7*c* with cyan toner so that there is formed a cyan toner image on the peripheral surface of the drum 5*c*. As the drum 5*c* is further driven to rotate, the cyan toner image is treated by the pretranfer corona device 8*c* and then transferred to a transfer medium by the image transfer corona device 9*c* as will be described more in detail later. Thereafter, the peripheral surface of the drum 5*c* is treated by the quenching lamp 10*c* so that any residual charge on the peripheral surface is removed. A still further rotation of the drum 5*c* brings that portion of the peripheral surface which has been treated by the quenching lamp 10*c* below the primary charging device 6*c*. In this manner, a process of uniform charging, image exposure, developing, transferring, and removal of residual charge may be repeated in association with the rotation of the drum 5*c*. However, since the cyan toner image formed on the drum 5*c* is not immediately transferred to the transfer medium but after a predetermined number of rotations in the present embodiment, it is so structured that the lamp 3*c*, primary charger 6*c* and quenching lamp 10*c* are held inoperative until the cyan toner image thus formed on the drum 5*c* has been transferred to the transfer medium.

The second imaging station M is disposed next to the first imaging station C and they are, in principle, identical in structure. Thus, the various elements of the second imaging station M which correspond to those of the first imaging station C are indicated by the same numerals accompanied by small letter "m". It is to be noted, however, that the second imaging station M starts its imaging operation after elapsing a predetermined time period subsequent to the initiation of the imaging operation by the first imaging station C. It should also be noted that green light image exposure takes place at this second imaging station M and the developing device 7*m* uses magenta toner. Similarly, the third imaging station Y is disposed next to the second imaging station M. At the third imaging station Y, blue light image exposure is carried out and thus the developing device 7*y* uses yellow toner.

It should also be noted that all of the three photosensitive drums 5*c*, 5*m*, and 5*y* have the same diameter D, and they are so connected to be driven by a main motor 13 fixedly mounted on the housing of the copier 1. The photosensitive drums 5*c*, 5*m*, and 5*y* are arranged side-by-side in the horizontal direction and spaced apart one from another center-to-center at a predetermined pitch, which is half of the circumferential length of the drum 5 in the illustrated embodiment. Disposed below and common to the three photosensitive drums 5*c*, 5*m*, and 5*y* is a transporting belt 11 in the form of an endless shape. The endless transport belt 11 extends generally horizontally between a pair of support rollers 14 and 15 over a distance beyond the outer drums 5*c* and 5*y*, and it is driven to run so as to transport a transfer medium 12 from left to right in FIG. 1 as riding thereon. That is, the support roller 14 is comprised of rubber and operatively coupled to the main motor 13 through a timing belt 16. A corona charging device 17 is disposed opposite to the belt 11 around the support roller 14 so that the belt 11 is charged, while moving around the support roller 14, thereby having the transfer medium 12 electrostatically attracted to the belt 11 when supplied. Also provided adjacent to the left end of the belt 11 is a registration roller 19 which receives the transfer medium 12 from a tray 18 on which a stack of transfer mediums 12 is stored and supplies it to the endless belt 11 in propre timing. The registration roller 19 located as spaced apart from the photosensitive drum 5*y* over a distance corresponding to half of the circumferential length of the drum 5*y*. When the transfer medium 12 is supplied, the endless belt 11 transports it past an image transfer section of each of the three imaging stations C, M, and Y, which is defined by a gap between the drum 5 and the transfer corona device 9, so that the three color-separated component images are transferred to the transfer medium 12 on the belt 11. After image transfer, the transfer medium 12 is separated from the belt 11 when it reaches the support roller 15 due to the sudden change of advancement of the belt 11 around the support roller 15. Thus, the support roller 15 also serves as a separating roller and its diameter is appropriately determined to obtain a proper separating function. After separation, the transfer medium 12 is moved past an image fixing device 20 where the three color component toner images are fixed to the transfer medium 12. It is to be noted that the registration roller 19 is also driven to rotate by the main roller 13 through the timing belt 16 similarly with support roller 14.

Auxiliary support rollers 21 and 22 are also provided in rolling contact with the forward run of the belt 11 so as to keep it in position. It should be noted that the support roller 15 is rotatably mounted at a free end of a support arm 24 which has is proximal end pivotted at a pivot 23. The transfer corona device 9c is also mounted on the support arm 24 so that the support roller 15 and the transfer corona device 9c are moved closer to or separated away from the drum 5c in unison. Thus, when the support roller 15 is located at its upper position, the belt 11 is brought into rolling contact with the drum 5c so that a cyan toner image formed on the drum 5c may be transferred to the transfer medium 12; on the other hand, when the support roller 15 is moved to its lower position, the belt 11 is separated away from the drum 5c and thus is not in contact therewith. With this structure, the belt 11 is normally separated away from the drum 5c and is brought into rolling contact with the drum 5c only when necessary. Similarly, the auxiliary support roller 22 is so provided to be shiftable between upper and lower positions. Thus, when the auxiliary support roller 22 is located at its upper position, the belt 11 is brought into rolling contact with the drum 5m; on the other hand, when the roller 22 is moved to its lower position, the belt 11 is separated away from the drum 5m. With this structure, the belt 11 is also normally separated away from the drum 5m and it is brought into rolling contact with the drum 5m only when necessary. On the other hand, in the illustrated embodiment, the belt 11 is always in rolling contact with the drum 5y because the color component image formed on the drum 5y is a last image and thus it can be transferred to the transfer medium 12 immediately.

Also provided in the color copier 1 are a corona unit 25 for removing charge from the belt 11 and a cleaning device 26 for cleaning the belt 11.

Now, it will be described as to the operation of the color copier 1 having the above-described structure. Initially, the support roller 15 is located at its lower position and the auxiliary support roller 22 is also located at its lower position so that the belt 11 is not in rolling contact with the photosensitive drums 5c and 5m. Thus, the belt 11 is only in rolling contact with the photosensitive drum 5y. Under the condition, the original holder 2 having thereon an original to be copied moves rightward or in the forward direction so that at first a cyan toner image of the original is formed on the drum 5c when developed by the developing device 7c. After formation of the cyan toner image on the drum 5c, the pretransfer corona device 8c, transfer corona device 9c, quenching lamp 10c, and primary corona charging device 6c are held inoperative while keeping the drum 5c in rotation. As the original holder 2 further moves in the forward direction, a magenta toner image of the original is formed on the drum 5m by the developing device 7m, and, similarly, after formation of the magenta toner image on the drum 5m, selected components of the second imaging station M are held inoperative while keeping the drum 5m in rotation.

Then, upon arrival of the leading edge of the original placed on the original holder 2 at the third imaging station Y, the transfer medium 12 is supplied to the transport belt 11 and thus the transfer medium 12 is electrostatically attracted to the belt 11 due to the charge applied by the corona charging device 17. And, as the transfer medium 12 is transported as riding on the belt 11, the yellow toner image formed on the drum 5y is transferred to the transfer medium 12 at its proper position by means of the transfer corona device 9y. Thereafter, the transfer medium 12 having thereon the transferred yellow toner image is transported toward the second imaging station M as riding on the belt 11, and immediately before the transfer medium 12 arrives at the second imaging station M, the auxiliary support roller 22 is moved to its upper position thereby causing the transfer medium 12 being transported by the belt 11 to be brought into contact with the drum 5m, so that the magenta toner image formed on the drum 5m is transferred to the transfer medium 12 being transported by the belt 11 as superposed on the transferred yellow toner image.

Similarly, the transfer medium 12 now having thereon the yellow and magenta toner images superposed one on top of the other is transported to the third imaging station C, in which case the arm 24 is pivotted to locate the support roller 15 at its upper position so that the transfer medium 12 being transported by the belt 11 is brought into contact with the drum 5c, whereby the cyan toner image formed on the drum 5c is transferred by means of the transfer corona device 9c to the transfer medium 12 as superposed on the already superposed yellow and magenta images, thereby forming a reproduced color image on the transfer medium 12. Thereafter, the transfer medium 12 is further transported by the belt 11 and it is separated from the belt 11 when it moves over the support roller 15 due to sudden change in movement of the belt 11 around the roller 15. Then, the transfer medium 12 is moved past the image fixing device 20, whereby the three toner images different in color and superposed one on top of another are fixed to the transfer medium 12.

As may be understood from the above explanation, the cyan toner image formed on the drum 5c at the first imaging station C is transferred to the transfer medium 12 on the belt 11 after having rotated over three times as riding on the drum 5c and thus having developed three times; on the other hand, the magenta toner image formed on the drum 5m at the second imaging station M is transferred to the transfer medium 12 on the belt 11 after having rotated twice as riding on the drum 5m and thus having developed twice. However, the yellow toner image formed on the drum 5y at the third imaging station Y is transferred to the transfer medium 12 immediately upon development.

It is to be noted that, in each imaging station, cleaning of the peripheral surface of the drum 5 is carried out by the developing device 7 after image transfer by switching bias voltages to be applied to the developing device 7, in particular its developing sleeve. It should also be noted that development is carried out more than once at the first and second imaging stations, and, therefore, in view of this, developing conditions should be appropriately set at each of these first and second developing stations. It may be easily seen that, in the illustrated embodiment, cleaning is effected more than once at the second and third imaging stations. In addition, in the illustrated embodiment, the color copier 1 is also provided with a shutter member 27 in each imaging station, and this shutter member 27 may be pivotted to its closed position to prevent light from passing through the exposure system 4 while the drum 5 rotates more than once with a toner image thereon.

As described above, in accordance with the illustrated embodiment of the present invention, upon arrival of the leading edge of the transfer medium 12 at the bottom position of the drum 5*y* at the third imaging station Y, the leading edge of the yellow toner image formed on the drum 5*y* comes to be located at the same position, and, under the condition, the central portion of the original holder 2 is located above the exposure system 4*y*. Thus, when the trailing edge of the original holder 2 is located above the exposure system 4*y*, the yellow toner image on the drum 5*y* is located with its central portion at the image transfer region between the drum 5*y* and the transfer corona device 9*y*.

While image transfer is in progress at the third imaging station Y, the other two drums 5*c* and 5*m* are in rotation with magenta and cyan toner images formed thereon, respectively, so that the transport belt 11 common to all of the three imaging stations C, M, and Y is positioned such that it is not in contact with the drums 5*c* and 5*m*. For this purpose, the rollers 15 and 22 are located at their lower positions. For example, in the case where each drum has an imaging region 210 mm long and a non-imaging region of 40 mm long around its circumference, when the transfer medium 12 arrives at the second imaging station M as transported by the belt 11, the auxiliary support roller 22 is moved to its upper position at the time when the non-imaging region of 40 mm long comes around to the bottom position thereby causing the transfer medium 12 to be brought into contact with the drum 5*m*. Similarly, at the first imaging station, the support roller 15 is moved to its upper position in proper timing to bring the transfer medium 12 in contact with the drum 5*c*.

As described above, in accordance with the illustrated embodiment of the present invention, the transporting belt 11 is provided common to all of the imaging stations, in particular photosensitive drums thereof, and the belt 11 is always in rolling contact with the drum 5*y* of the third imaging station Y, but it is brought into rolling contact with each of the drums 5*c* and 5*m* of the first and second imaging stations C and M, respectively, only at the time when required. And, the belt 11 is brought into contact with each of the drums 5*c* and 5*m* at the timing when the non-imaging region of the drum 5 is located at the transfer region, which is defined at the bottom of the drum 5 where the transfer corona device 9 is opposed to the drum 5. Preferably, it is so structured that the belt 11 is separated away from the drums 5*c* and 5*m* of the first and second imaging stations C and M, respectively, upon completion of image transfer at the first imaging station C.

In accordance with another aspect of the present invention, although not shown specifically, a detector for detecting the concentration of the toner in the developing device 7 is provided and the bias voltage applied to the developing sleeve is so controlled in accordance with a detection signal supplied from the detector, so that when the bias voltage is switched to a first level, the developing device 7 functions as a developing device to develop a latent image on the drum 5 by supplying the toner thereto selectively; whereas, when the bias voltage is switched to a second level, the developing device 7 functions as a cleaning device thereby removing any residual toner from the drum 5. Such a toner concentration detector is well known in the art and a control system for controlling the bias voltage to be applied to the developing sleeve in accordance with the detected toner concentration may also be constructed easily for one skilled in the art, for example, with the use of a microprocessor or the like.

As described above, in the illustrated embodiment, since the developing device 7 in each imaging station is so structured to perform dual functions of development and cleaning selectively just by changing the bias voltage to be applied between a developing bias and a cleaning bias, there is no need to provide individual developing and cleaning devices separately, which would greatly contribute to make the whole apparatus compact in size.

In accordance with a further aspect of the illustrated embodiment of the present invention, it is so structured that the registration roller 19 continues to rotate until the final image transfer step of a multi-color reproduction process has been completed. That is, it may be so structured that the registration roller 19 terminates its rotation when it has supplied the transfer medium 12 onto the belt 11. However, in accordance with this aspect of the present invention, the rotation of the registration roller 19 is stopped only after the final image transfer step at the first imaging station C has been completed. With this structure, fluctuations caused by terminating the rotation of the registration roller 19 are prevented from adversely affecting the image transfer step. Such a structure may be easily provided by detecting the timing of completion of the final image transfer step at the first imaging station C and terminating the rotation of the registration roller 19 in accordance with such a detecting signal.

In accordance with a still further aspect of the illustrated embodiment of the present invention, it is so structured that the illuminating light source 3, primary corona charging device 6, and transfer corona device 9 of each of alternate imaging stations, e.g., stations C and Y in FIG. 1, are connected to a common power supply switchingly. That is, from structural reasons, the illuminating light source 3*c*, primary corona charging device 6*c*, and transfer corona device 9*c* of the first imaging station C and the corresponding components 3*y*, 6*y*, and 9*y* of the third imaging station Y are not activated at the same time, and, thus, a common power supply may be provided so as to be used switchingly between the first and third, or alternate, imaging stations. Such a structure is advantageous in making the whole apparatus compact in size and simple in structure. Such an idea of providing a common power supply for selected components of between alternate imaging stations may also applicable to a color copier having four imaging stations.

In accordance with a still further aspect of the present invention, it is so structured that the primary corona charging device 6 in each imaging station has dual functions as a device for uniformly charging the drum 5 to a predetermined polarity and as a device for removing charge remaining on the drum 5. For this purpose, a power supply capable of supplying both a.c. and d.c. high voltage is provided and means for switching between a.c. and d.c. is also provided. For example, a d.c. high voltage is applied to the primary corona device 6 when the device 6 is to function as a charging device; on the other hand, an a.c. high voltage is applied to the primary corona device when cleaning of or removal of residual charge from the drum 5 is to be effected.

As described previously, the developing device 7 in each imaging station can function as a cleaning device for cleaning the drum 5 by removing residual toner therefrom after image transfer. In this case, since a power supply capable of supplying a d.c. high voltage or an a.c. high voltage selectively is connected to the primary corona device 6 in accordance with this aspect of the present invention, when cleaning of the drum 5 is to be effected after image transfer, the power supply is switched to supply an a.c. high voltage to the primary corona device 6 which thus serves to eliminate any residual charge on the drum 5, which, in turn, would aid in removing any residual toner from the drum 5.

In accordance with a still further aspect of the present invention, since a plurality of imaging stations are provided in a multi-color copier, a light source capable of emitting light of selected color is used and the light of selected color is applied to the corresponding drum 5 so as to remove any residual charge completely. That is, as described previously, in each imaging station, after image transfer from the drum 5 to the transfer medium 12, light is irradiated from the quenching lamp 10 to the drum 5 thereby eliminating the residual charge on the drum 5. In this case, however, since toner used is different in color between imaging stations, if the light irradiated from the quenching lamp 10 is of the color absorptive of the toner used in a particular imaging station, the light does not reach a photoconductive layer of the drum 5 due to absorption and thus removal of charge cannot be carried out effectively. Accordingly, in order to effect removal of residual charge from the drum 5 after image transfer, the light used for removing the residual charge should not be significantly absorbed by the residual toner on the drum 5 so as to reach the photoconductive layer provided around the periphery of the drum 5.

Therefore, in accordance with this aspect of the present invention, it is so structured that the color of the light used for removing the residual charge from the drum 5 is set as follows:

the color of light used for removing the residual charge from the drum **5*y*** for forming a yellow toner image thereon is other than blue and its similar colors;

the color of light used for removing the residual charge from the drum **5*m* for forming a magenta toner image thereon is other than green and its similar colors; and the color of light used for removing the residual charge from the drum 5*c*** for forming a cyan toner image thereon is other than red and its similar colors.

With this structure, the light of selected color can be used for effectively removing the residual charge from the drum without being absorbed by the toner used. Specifically, in the embodiment illustrated in FIG. 1, it is so structured that such light of selected color is emitted from the quenching lamp 10 in each imaging station. The lamp 10 may be comprised of a light-emitting diode or any other desired element.

Figure 2:
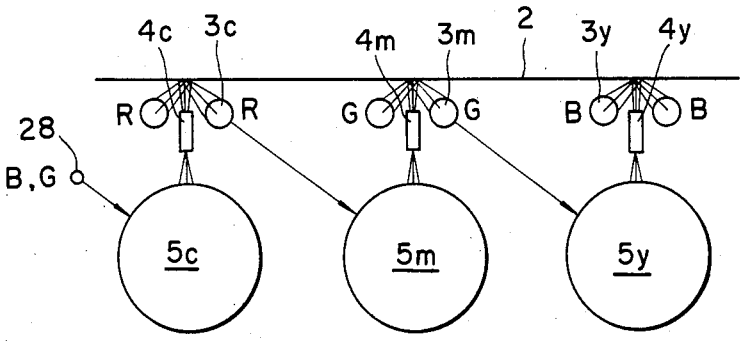
FIGS. 2 and 3 are schematic illustrations showing other embodiments of the present invention.

Now, in the illustrated embodiment, the color of the light which may be used for removing the residual charge from a particular drum agrees with the color of the light used for illuminating the original for color separation in the adjacent imaging station. Thus, it may be so structured that the light emitted from the illuminating lamp 3 in the adjacent imaging station is used to carry our removal of the residual charge from the particular drum 5 prior to uniform charging. FIG. 2 schematically illustrates an embodiment constructed in accordance with this principle. It is to be noted that like numerals are used in FIG. 2 to denote like elements shown in FIG. 1. In FIG. 2, B, G, and R indicate blue, green and red light sources, respectively. In the structure of FIG. 2, an independent light source 28 is provided for irradiating light having the color of either blue or green. The independent light source 28 corresponds to the quenching lamp **10*c* provided in the first imaging station C in the structure shown in FIG. 1, but this independent light source 28** is limited in the color of light to be emitted therefrom.

As may be understood, the independent light source 28 is provided for the first imaging station in the structure shown in FIG. 2 because of the difficulty in leading the light emitted from the illuminating lamp 3 of any other imaging station. However, if desired, an optical fiber or any other light-guiding element may be provided to lead the light having a proper color to the drum **5*c* of the first imaging station from the illuminating lamp 3 of any other imaging station. The light source 28 may be comprised of a light-emitting diode or any other desired element. In the embodiment illustrated in FIG. 2, it is so structured that the light emitted from the illuminating lamp 3 of the previous adjacent imaging station directly impinges upon the drum 5 of the next imaging station for removal of the residual light from the drum 5. However, if desired, light path changing means, such as mirrors, may be provided to guide the light emitted from the illuminating lamp 3 of the previous imaging station to fall onto the drum 5 of the next adjacent imaging station. Although the embodiment shown in FIG. 2 is the case where three drums 5*c*, 5*m*, and 5*y*** are provided, this principle may also be applied to a multi-color copier using four photosensitive drums as long as a drum for forming a yellow toner image is arranged at the final imaging station.

Now, a still further aspect of the present invention will be described with reference to FIG. 3. In the embodiment illustrated in FIG. 1, in each imaging station, the light emitted from the lamp 8 is applied to the drum 5 immediately before or at the time of image transfer from the drum 5 to the transfer medium 12 so as to remove the charge from the drum 5 thereby improving the transfer efficiency of the toner image to the transfer medium 12. However, as mentioned in connection with the above-described embodiment shown in FIG. 1, the color of the toner differs from one imaging station to another so that if the light is absorbed by the toner on the drum 5, the light cannot reach the photoconductive layer of the drum 5 and thus the charge cannot be removed from the drum effectively. Thus, the light used for removing the charge from the drum 5 at the time of or immediately before the image transfer step should have a particular color or wavelength which is not easily absorbed by the toner on the drum 5. Accordingly, in accordance with this aspect of the present invention, the wavelength of the light used for removing the charge from the drum at the time of or immediately before the image transfer step is determined as follows:

the light used for removing the charge from the drum 5y for forming a yellow toner image thereon has the wavelength other than that of blue or its similar colors;

the light used for removing the charge from the drum 5m for forming a magenta toner image thereon has the wavelength other than that of green or its similar colors; and the light used for removing the charge from the drum 5c for forming a cyan toner image thereon has the wavelength other than that of red or its similar colors.

Accordingly, in accordance with this aspect of the present invention, the wavelength of the light emitted from the lamp 8 in each imaging station in the multicolor copier shown in FIG. 1 differs one imaging station from another, and the wavelength of the light emitted from each of the lamps 8c, 8m, and 8y is set according to the above-mentioned conditions. The lamp 8 may be comprised of a light-emitting diode or any other appropriate element. Incidentally, in the embodiment illustrated in FIG. 1, the color of the light suitable for use in eliminating the charge from the drum 5 in accordance with the above-mentioned conditions agrees with that of the light emitted from the illuminating lamp 3 in the next adjacent imaging station for color separation exposure of the original image. Thus, it is preferable to utilize the light emitted from the illuminating lamp 3 in the next adjacent imaging station for removing the charge from the drum 5 at the time of or immediately before the image transfer step in the present imaging station, as shown in FIG. 3.

Figure 3:
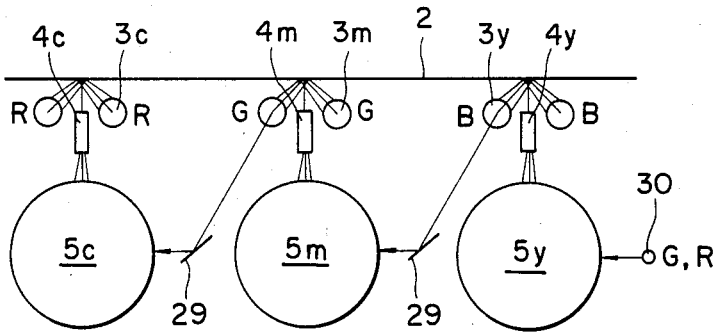

It is to be noted that like elements shown in FIGS. 1 and 2 are used to denote identical elements in FIG. 3. Also provided in the structure of FIG. 3 is an independent lamp 30 as located to the right of the drum 5y, and the lamp 30 emits light having the wavelength corresponding to green or red in color. As understood, the independent lamp 30 corresponds to the pretransfer charge removing lamp 8y of the third imaging station Y. Alternatively, an optical fiber or any other light-guiding element may be used to guide the light from the illuminating lamp 3 of any other imaging station to impinge upon the drum 5y for removal of the charge therefrom. The lamp 30 may also be comprised of a light-emitting diode or any other appropriate element. In the structure shown in FIG. 3, the light emitted from the illuminating lamp 3 of the next following imaging station is caused to impinge upon the drum 5 of the present or previous imaging station as once reflected by a mirror 29; however, more than one mirror may be provided to guide the light to a desired position or the light may also be directly applied to the drum 5. Although the embodiment shown in FIG. 3 is the case where three drums 5c, 5m, and 5y are provided, this principle may also be applied to a multi-color copier using four photosensitive drums as long as a drum for forming a yellow toner image is arranged at the final imaging station.

As described before, the color copier shown in FIG. 1 is provided with the shutter member 27 in each of the three imaging stations. Since a cyan toner image formed on the drum 5c is transferred to the transfer medium 12 after having rotated three times and similarly a magenta toner image formed on the drum 5m is transferred to the transfer medium 12 after having rotated twice; whereas, a yellow toner image formed on the drum 5y is immediately transferred to the transfer medium 12. Since the cyan and magenta toner images are not transferred to the transfer medium 12 immediately, there is a danger that these cyan and magenta toner images are disturbed while waiting to be transferred to the transfer medium 12. In order to prevent this from occurring, the shutter member 27c or 27m is provided between the exposure system 4 and the drum 5 in each of the first and second imaging stations C and M, and the shutter member 27 is located at the closed position to block the optical path leading from the exposure system 4 to the drum 5 other than image exposure takes place for the imaging station in question. In the embodiment shown in FIG. 1, the shutter member 27y is also provided for the third imaging station Y, and, thus, the optical path between the exposure system 4 and the drum 5y may also be blocked, if desired, other than the time when image exposure is carried out. However, since the yellow toner image is transferred to the transfer medium 12 immediately upon formation, the shutter member 27y may be discared, if desired. Although the shutter member 27 is provided to be pivotal between its closed position to block the optical path between the exposure system 4 and the drum 5 and its open position to clear the optical path between the exposure system 4 and the drum 5, the shutter member 27 may also be provided to be slidable between its closed and open positions.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A copying apparatus comprising:

holding means driven to move along a first predetermined path in a reciprocating manner for holding thereon an original to be copied;

scanning means for scanning said original while said holding means moves in a forward direction along said first predetermined path;

a plurality of imaging means for forming thereon toner images of different color components of said original;

transporting means for transporting a transfer medium along a second predetermined path, which is generally in parallel with said first predetermined path, in a direction opposite to said forward direction, to thereby transfer said toner images one after another in sequence from said plurality of imaging means to said transfer medium to obtain a reproduced color copy of said original;

wherein said scanning means includes a like plurality of illuminating light sources for illuminating said original and exposure systems each for the corresponding one of said plurality of imaging means, each of said plurality of exposure systems exposing said original to the corresponding one of said imaging means to form a particular color component image of said original under color separation;

wherein each of said plurality of imaging means includes a photosensitive drum driven to rotate in a predetermined direction and having an imaging surface around its periphery, primary charging means for uniformly charging said imaging surface so as to be later selectively dissipated by a light image of said original applied by the corresponding one of said plurality of exposure systems to form an electrostatic latent image, developing means for developing said latent image with toner of selected color to form a toner image of selected color, and image transferring means for transferring said toner image of selected color to said transfer medium; and wherein each of said plurality of imaging means further includes a first light irradiating means for irradiating, with light of a first color, said imaging surface of said drum after formation of said toner image of selected color, and a second light irradiating means for irradiating, with light of a second color, said imaging surface of said drum after image transfer.

2. Apparatus of claim 1 wherein a bias voltage applied to said developing means is switched between a developing bias voltage and a cleaning bias voltage, whereby said developing means functions as a developing device and a cleaning device selectively.

3. Apparatus of claim 1 wherein selected components of alternate ones of said plurality of imaging means are selectively connectable to a common power supply.

4. Apparatus of claim 3 wherein said selected components include said primary charging means, image transferring means, and illuminating light source.

5. Apparatus of claim 1 wherein said primary charging means is selectively connectable to a d.c. high voltage or to an a.c. high voltage, whereby said primary cnarging means is connected to said d.c. high voltage when uniformly charging said imaging surface of said drum and to said a.c. high voltage when removal of charge from said drum and/or cleaning of said drum is to be carried out.

6. Apparatus of claim 1 wherein said first light differs in color from imaging means to imaging means.

7. Apparatus of claim 6 wherein said first light has a first color other than blue and its similar colors if said imaging means forms a yellow toner image, a second color other than green and its similar colors if said imaging means forms a magenta toner image, and a third color other than red and its similar colors if said imaging mean forms a cyan toner image.

8. Apparatus of claim 7 wherein said first light to be used in one of said imaging means is the light emitted from the illuminating light source of one of the other imaging means.

9. Apparatus of claim 1 wherein said second light differs in color from imaging means to imaging means.

10. Apparatus of claim 9 wherein said second light has a first color other than blue and its similar colors if said imaging means forms a yellow toner image, a second color other than green and its similar colors if said imaging means forms a magenta toner image, and a third color other than red and its similar colors if said imaging mean forms a cyan toner image.

11. Apparatus of claim 10 wherein said second light to be used in one of said imaging means is the light emitted from the illuminating light source of one of the other imaging means.

* * * * *